US009136644B2

(12) United States Patent
Yu et al.

(10) Patent No.: US 9,136,644 B2
(45) Date of Patent: Sep. 15, 2015

(54) CONNECTOR ASSEMBLY WITH CONTACTS HAVING RETAINING PORTIONS WITH INTERLOCKING STRUCTURES

(71) Applicant: ALLTOP ELECTRONICS (SUZHOU) CO., LTD., Taicang, JiangSu Province (CN)

(72) Inventors: Wang-I Yu, Jhonghe (TW); Hung-Chi Tai, Jhonghe (TW); Yung-Chih Hung, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/249,936

(22) Filed: Apr. 10, 2014

(65) Prior Publication Data

US 2015/0180169 A1 Jun. 25, 2015

(30) Foreign Application Priority Data

Dec. 23, 2013 (CN) ..... 2013 1 0715413

(51) Int. Cl.
*H01R 13/627* (2006.01)
*H01R 13/64* (2006.01)

(52) U.S. Cl.
CPC ..... *H01R 13/6271* (2013.01); *H01R 13/6273* (2013.01); *H01R 13/64* (2013.01)

(58) Field of Classification Search
USPC ..... 439/352–372
See application file for complete search history.

(56) References Cited

U.S. PATENT DOCUMENTS

| | | | | |
|---|---|---|---|---|
| 6,093,045 | A * | 7/2000 | Hoff | 439/357 |
| 6,786,755 | B2 * | 9/2004 | Dambach et al. | 439/353 |
| 7,374,460 | B1 * | 5/2008 | Hariharesan et al. | 439/679 |
| 7,594,827 | B2 * | 9/2009 | Takamoto et al. | 439/660 |
| 7,749,029 | B1 * | 7/2010 | Pontillo, II | 439/678 |
| 2009/0075513 | A1 * | 3/2009 | Amidon | 439/352 |
| 2012/0077369 | A1 * | 3/2012 | Andersen | 439/488 |
| 2012/0329336 | A1 * | 12/2012 | Li et al. | 439/680 |
| 2013/0040485 | A1 * | 2/2013 | Ngo | 439/350 |

* cited by examiner

*Primary Examiner* — Chandrika Prasad
(74) *Attorney, Agent, or Firm* — Sughrue Mion, PLLC

(57) ABSTRACT

A connector assembly includes a receptacle connector and a plug connector. The receptacle connector includes a receptacle insulative housing and a number of female contact groups fixed in the receptacle insulative housing. The receptacle insulative housing includes a receiving portion, a plurality of mating portions and a pair of locking arms integrally formed at opposite lateral sides of the receptacle insulative housing. The plug connector includes a plug insulative housing and a number of male contacts fixed in the plug insulative housing. The plug insulative housing includes a mating surface, a plurality of cavities and a pair of locking walls located at opposite lateral sides of the plug insulative housing. When the plug connector the receptacle connector are mating with each other, the locking arms are in locking with the locking walls for fixation.

19 Claims, 15 Drawing Sheets

CONNECTOR ASSEMBLY WITH CONTACTS HAVING RETAINING PORTIONS WITH INTERLOCKING STRUCTURES

CROSS-REFERENCE TO RELATED APPLICATIONS

This application is related to the following co-pending U.S. patent applications, which are entitled "CONNECTOR ASSEMBLY WITH STABLE STRUCTURES" and "CONNECTOR ASSEMBLY WITH IMPROVED CONTACT ARRANGEMENT". Such applications have the same assignee as the instant application filed herewith. The disclosures of the above-identified applications are incorporated herein by reference.

BACKGROUND

1. Technical Field

The present invention relates to a connector assembly, and more particularly to a receptacle connector and a plug connector with improved locking structures for mating with each other.

2. Description of Related Art

With rapid development of electronic technologies, connector assemblies have been widely used in electronic devices for exchanging information and data with external devices. A conventional connector usually includes an insulative housing, a plurality of contacts received in the insulative housing and a metallic shell enclosing the insulative housing. The connector assembly includes a receptacle connector for being mounted to a circuit board and a plug connector for mating with the receptacle connector.

In order to meet the requirements of stable signal transmission and high effective transmission of the electronic devices, strong mating stabilization of the electrical connector needs to be ensured. However, the receptacle connector and the plug connector does not provide stably locking structures, as a result that it the plug connector may be easily withdraw from the receptacle connector when they are mating.

Hence, a connector assembly with improved locking structures is desired.

SUMMARY

An embodiment of the present invention provides a connector assembly including a receptacle connector and a plug connector mating with the receptacle connector. The receptacle connector includes a receptacle insulative housing and a plurality of female contact groups fixed in the receptacle insulative housing. The receptacle insulative housing includes a receiving portion, a plurality of mating portions extending from the receiving portion and a pair of locking arms integrally formed at opposite lateral sides of the receptacle insulative housing. Each female contact group includes a pair of resilient contacting portions. The plug connector includes a plug insulative housing and a plurality of male contacts fixed in the plug insulative housing. The plug insulative housing includes a mating surface, a plurality of cavities extending through the mating surface and a pair of locking walls located at opposite lateral sides of the plug insulative housing. Each male contact includes a rigid contacting portion extending into corresponding cavity. when the plug connector the receptacle connector are mating with each other, the mating portions of the receptacle connector are inserted in the cavities of the plug connector with the rigid contacting portion sandwiched by the pair of resilient contacting portions, and the locking arms are in locking with the locking walls for fixation.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENTS

Figure 1:
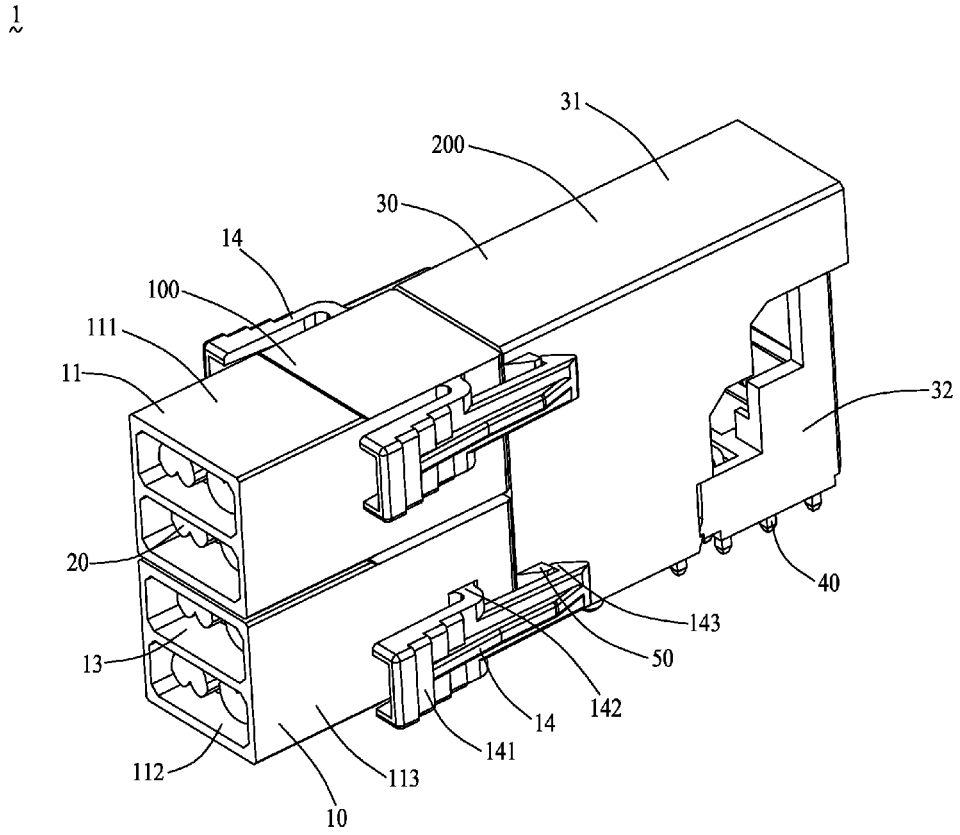
FIG. 1 is a perspective view of a connector assembly in accordance with an illustrated embodiment of the present invention.

Reference will now be made to the drawing figures to describe the embodiments of the present invention in detail. In the following description, the same drawing reference numerals are used for the same elements in different drawings.

Referring to FIG. 1, an embodiment of the present invention discloses a connector assembly 1 including a receptacle connector 100 for connecting to cables and a plug connector 200 for being mounted on a circuit board (not shown) for mating with the receptacle connector 100.

Figure 2:
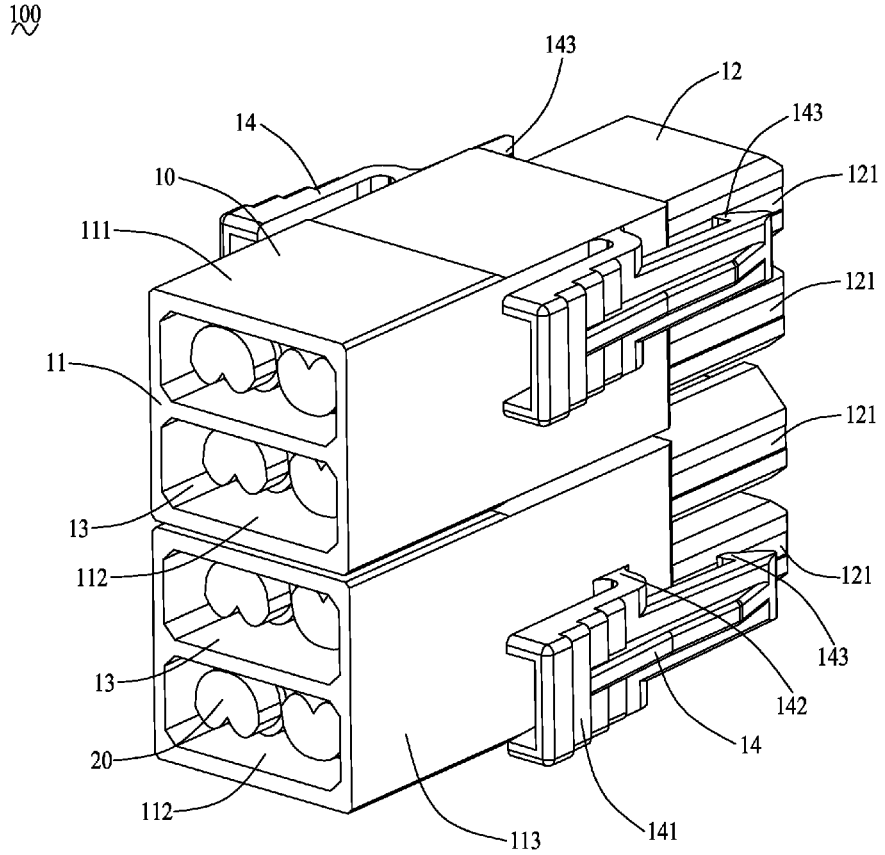
FIG. 2 is a perspective view of a receptacle connector as shown in FIG. 1.
Figure 3:
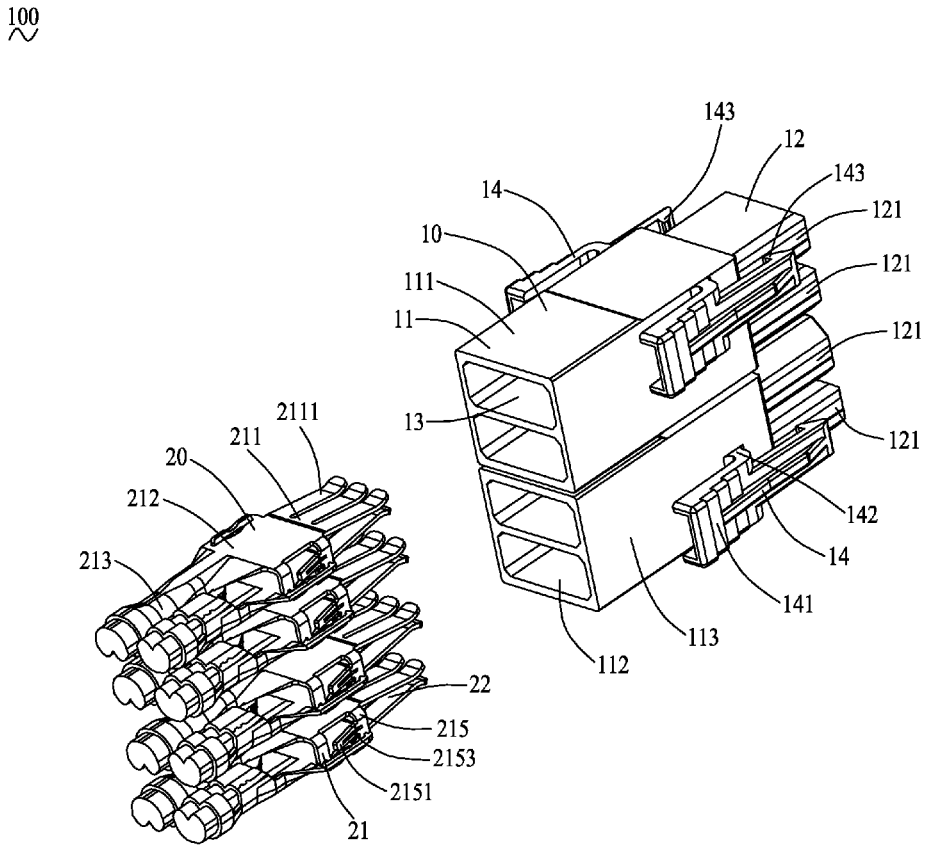
FIG. 3 is an exploded view of the receptacle connector as shown in FIG. 2.

Referring to FIGS. 2 and 3, the receptacle connector 100 includes a receptacle insulative housing 10 and a plurality of female contact groups 20 retained in the receptacle insulative housing 10.

Figure 4:
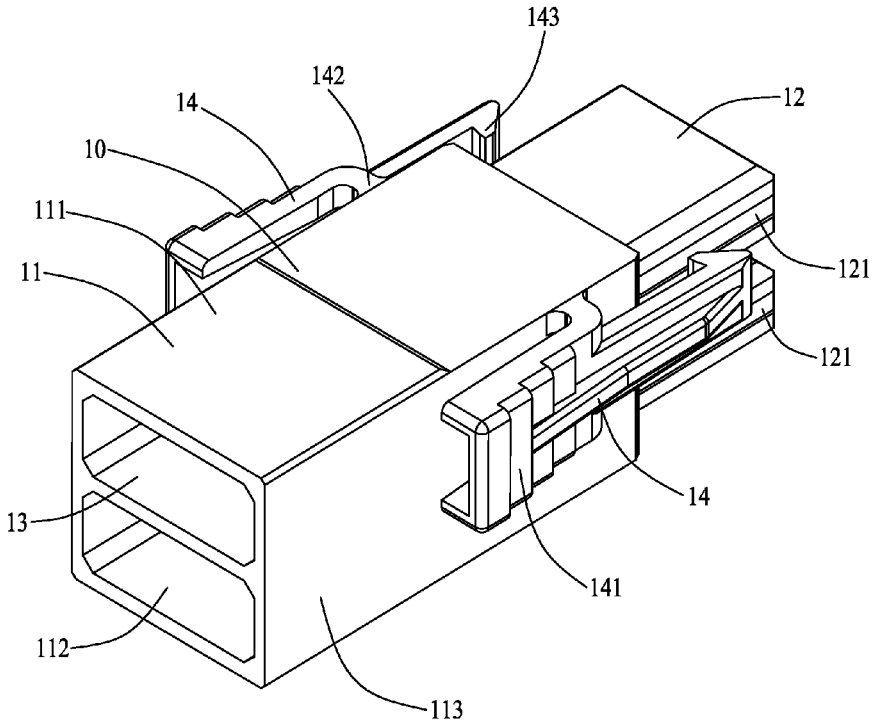
FIG. 4 is a perspective view of a receptacle insulative housing as shown in FIG. 3.
Figure 5:
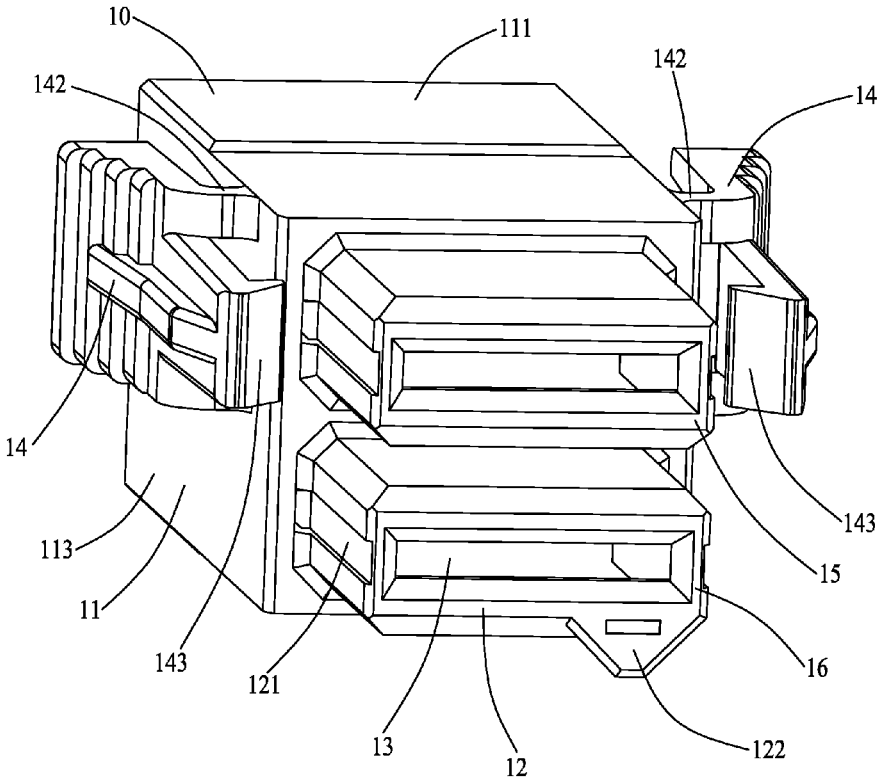
FIG. 5 is another perspective view of the receptacle insulative housing as shown in FIG. 4.

Referring to FIGS. 4 and 5, the receptacle insulative housing 10 includes a receiving portion 11, a plurality of mating portions 12 extending forwardly from the receiving portion 11 and a plurality of contact-receiving slots 13 extending through the mating portions 12 and the receiving portion 11 along a front-to-rear direction. According to the illustrated embodiment of the present invention, there are two mating portions 12 stacked along a vertical direction. The two mating portions 12 include an upper mating portion 15 and a lower mating portion 16. Each mating portion 12 defines one contact-receiving slot 13 extending through the receiving portion 11 for accommodating one female contact group 20.

Referring to FIGS. 2 to 5, each mating portion 12 defines a pair of sideward slots 121 extending forwardly therethrough. The sideward slots 121 are adapted for mating with the plug connector 200 for stabilize mating. The sideward slots 121 extend rearwardly into the receiving portion 11 and in communication with corresponding contact-receiving slot 13. As a result, heat generated by the female contact groups 20 can be dissipated to the exterior via such sideward slots 121.

The lower mating portion 16 includes a trapezoid anti-mismating block 122 at a corner thereof. The anti-mismating block 122 protrudes along a direction opposite to the upper mating portion 15. As a result, the anti-mismating block 122 can prevent the receptacle connector 100 from mating with unmatched plug connectors.

The receiving portion 11 includes a top wall 111, a bottom wall 112 opposite to the top wall 111 and a pair of side walls 113 connecting the top wall 111 and the bottom wall 112. Besides, the receptacle insulative housing 10 includes a pair of locking arms 14 located at opposite sides of the upper mating portion 15 for locking with the plug connector 200. Each locking arm 14 includes a pivot portion 142 connected to the side wall 113 of the receiving portion 11, a rear pressing portion 141 for deforming the locking arm 14 and a front distal hook 143 adjacent to the upper mating portion 15.

Figure 6:
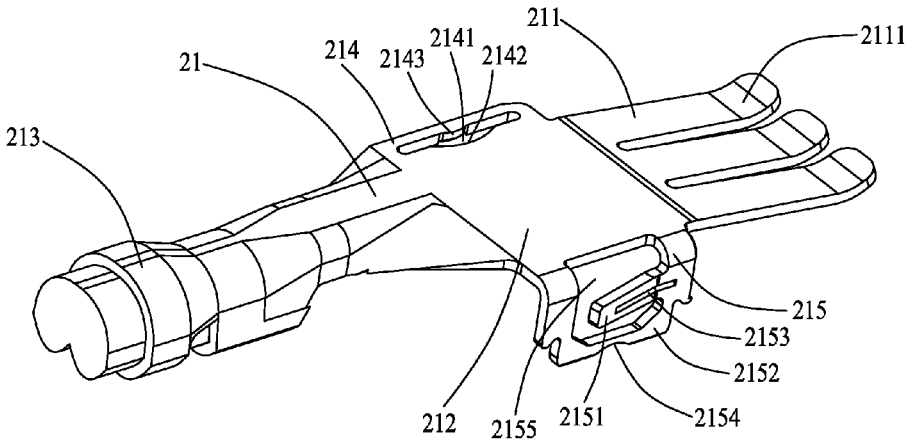
FIG. 6 is a perspective view of one of the female contacts as shown in FIG. 3.

Referring to FIGS. 4 to 6, the female contact groups 20 are received in the contact-receiving slots 13. Each female contact group 20 includes first and second female contacts 21, 22 combined together. According to the illustrated embodiment of the present invention, the first female contact 21 is of the same configuration as the second female contact 22 after rotating 180 degrees. As a result, only one mould is enough for the first and second female contacts 21, 22 in manufacturing. Each of the first and second female contacts 21, 22 includes a retaining portion 212, a contacting portion 211 extending forwardly from the retaining portion 212 and a clip portion 213 extending rearwardly from the retaining portion 212 for mounting a cable. Each contacting portion 211 of the first and second female contacts 21, 22 includes a plurality of resilient contacting arms 2111 for mating with the plug connector 200. Each retaining portion 212 includes a first locking portion 214 and a second locking portion 215 on opposite lateral sides thereof, respectively.

Each first locking portion 214 includes a slit 2141, a guiding protrusion 2143 extending into the slit 2141 and a recess 2142 in communication with the slit 2141. The recess 2142 is opposite to the guiding protrusion 2143 and the guiding protrusion 2143 extends towards the recess 2142. The guiding protrusion 2143 includes a curved outer surface, and the recess 2142 includes a curved inner surface as well.

The second locking portion 215 is bent from a side edge of the retaining portion 212 and is perpendicular to the first locking portion 214. Each second locking portion 215 includes a positioning portion 2152 and an engaging arm 2151 outside of the positioning portion 2152. The engaging arm 2151 extends slantwise along a rear-to-front direction and includes a reinforced rib 2153 on an outer surface thereof. When the female contact groups 20 are inserted into the contact-receiving slots 13, the reinforced ribs 2153 function as guiding and restricting. Besides, the second locking portion 215 defines an opening 2155 into which the engaging arm 2151 extends. Each positioning portion 2152 includes a recess 2154 formed at a distal end thereof for guidance and restriction. The recess 2154 is located at a middle of the positioning portion 2152 and is of a rectangular or a trapezoid or a curved configuration.

Since the contacting portions 211, the retaining portions 212 and the clip portions 213 of the first female contact 21 and the second female contact 22 are of the same configurations after one of the first female contact 21 and the second female contact 22 rotates 180 degrees. In assembly, two female contacts are provided in which one acts as the first female contact 21 and the other is reversed 180 degrees to act as the second female contact 22. When the first female contact 21 is combined in position with the second female contact 22, the positioning portion 2152 of the first female contact 21 extends through the slit 2141 of the second female contact 22, and the positioning portion 2152 of the second female contact 22 extends through the slit 2141 of the first female contact 21, simultaneously. After assembling, as shown in FIG. 3, in the same female contact group 20, the contacting portions 211 of the first and second female contacts 21, 22 are located one above the other along the vertical direction, while the clip portions 213 of the first and second female contacts 21, 22 are located side by side along a horizontal direction perpendicular to the vertical direction.

Figure 7:
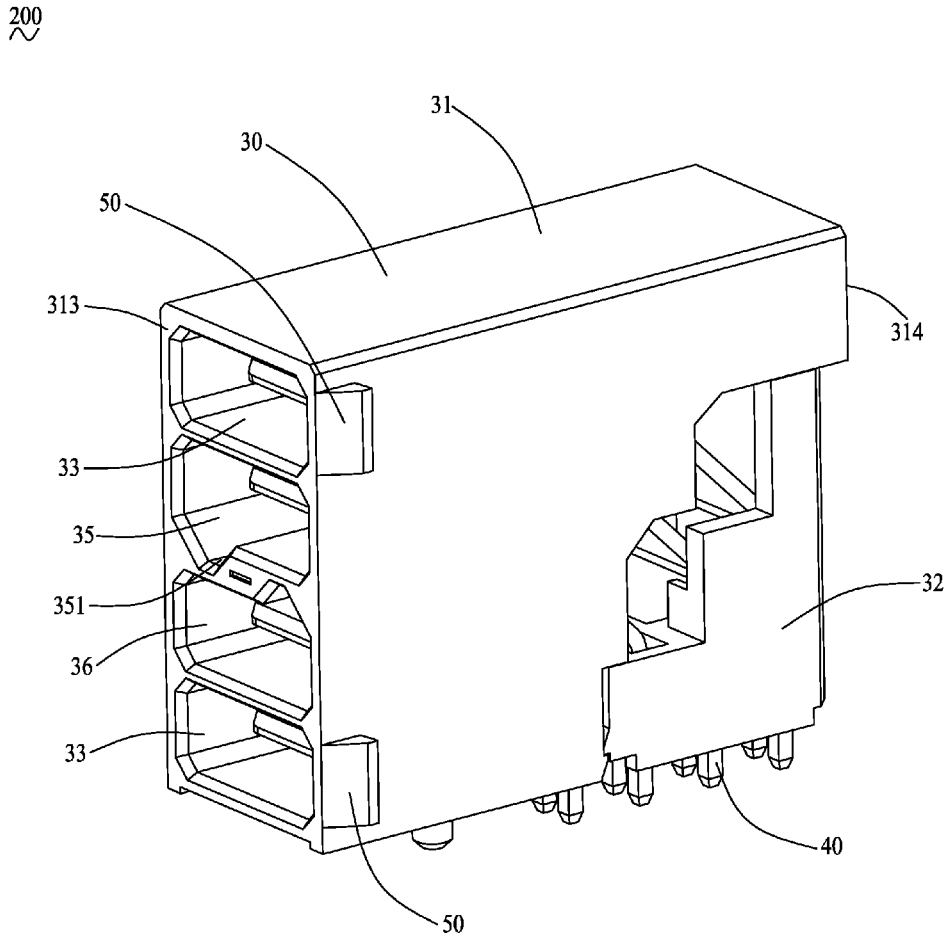
FIG. 7 is a perspective view of a plug connector as shown in FIG. 1.
Figure 8:
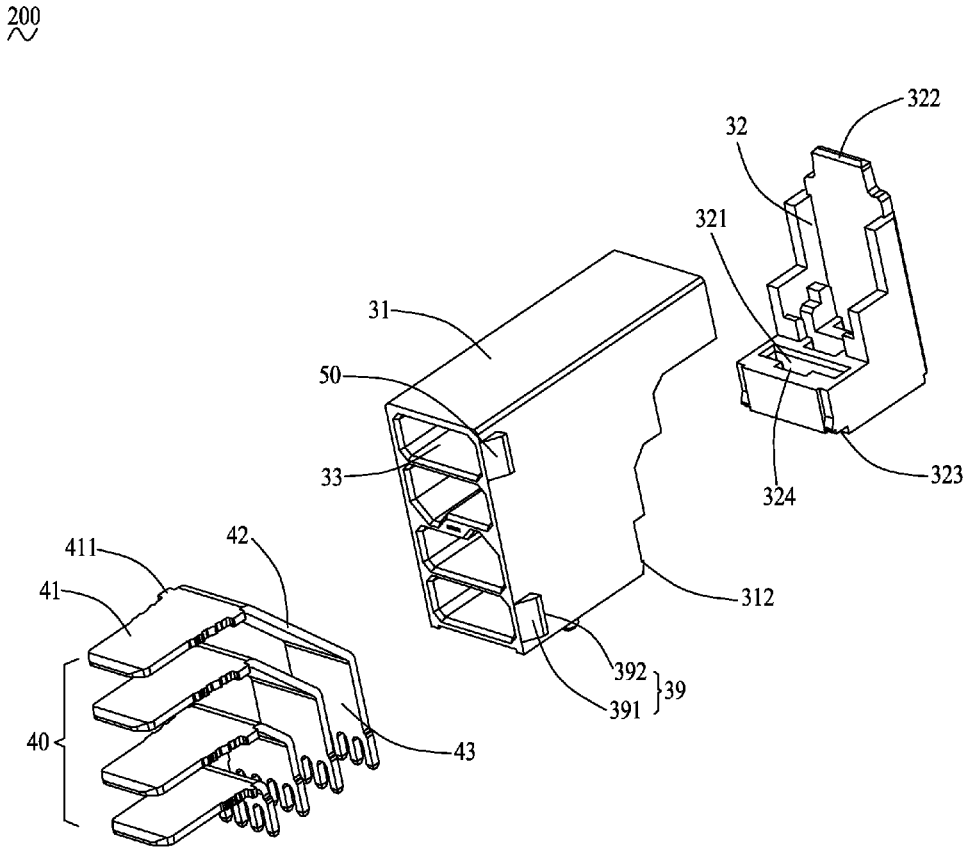
FIG. 8 is an exploded view of the plug connector as shown in FIG. 7.

Referring to FIGS. 1, 7 and 8, the plug connector 200 includes a plug insulative housing 30 and a plurality of male contacts 40 retained in the plug insulative housing 30.

Figure 9:
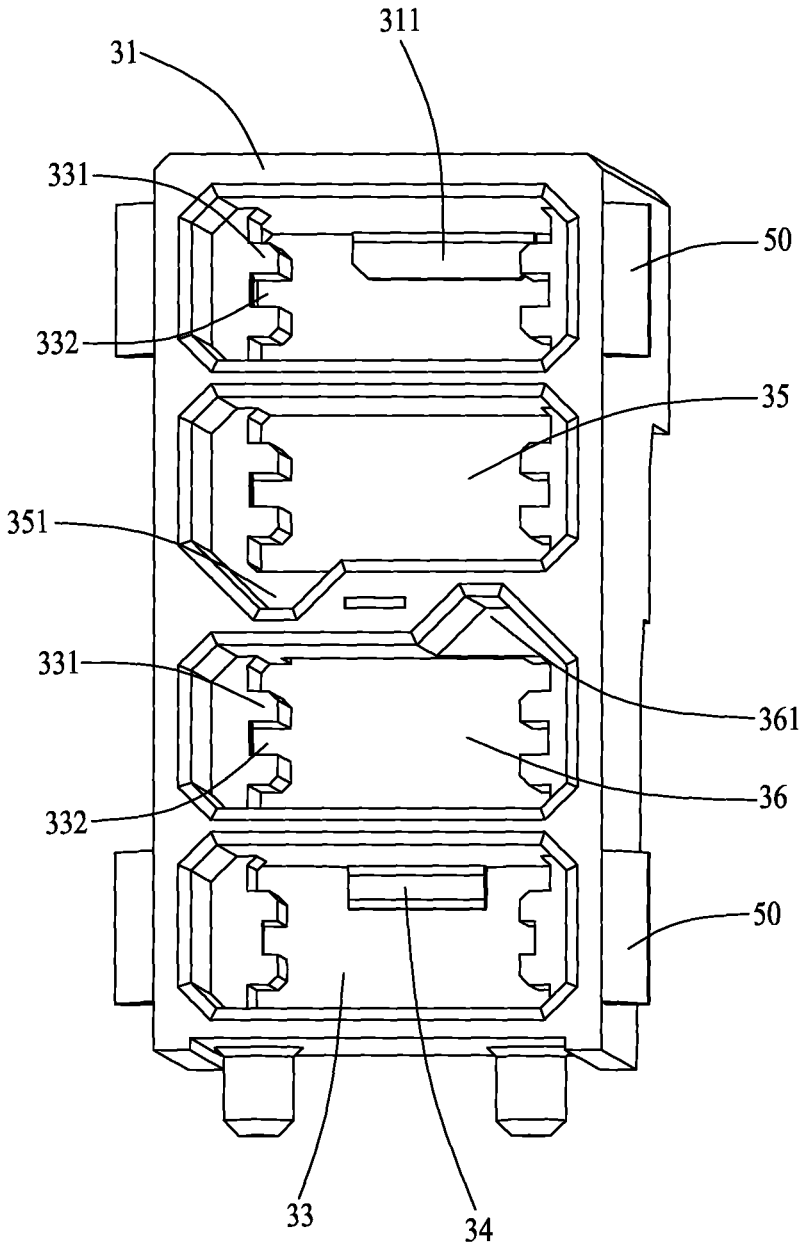
FIG. 9 is a perspective view of a plug insulative housing as shown in FIG. 8.

Referring to FIGS. 7 to 10, the plug insulative housing 30 includes a body portion 31 and a spacer 32 attached to the body portion 31 for organizing the male contacts 40. The body portion 31 includes a front mating surface 313, a rear mounting surface 314, a plurality of cavities 33 extending forwardly through the front mating surface 313 and a plurality of contact-receiving slots 332 extending rearwardly through the rear mounting surface 314. Each contact-receiving slot 332 is formed between two projections 331. The cavities 33 are stacked one above the other along the vertical direction, wherein the cavities 33 include a first cavity 35 and a second cavity 36 under the first cavity 35. The first cavity 35 and the cavity 33 located above the first cavity 35 jointly form an upper port, and the second cavity 36 and the cavity 33 located under the second cavity 36 jointly form a lower port. The plug insulative housing 30 defines a first anti-mismating groove 351 at a corner of the first cavity 35 and a second anti-mismating groove 361 at a corner of the second cavity 36. The first anti-mismating groove 351 and the second anti-mismating groove 361 are in communication with the first cavity 35 and the second cavity 36, respectively, while the first anti-mismating groove 351 and the second anti-mismating groove 361 are offset along the vertical direction and extend along opposite directions. As shown in FIG. 9, the first anti-mismating groove 351 and the second anti-mismating groove 361 are of trapezoid configurations. The first anti-mismating groove 351 extends downwardly along the vertical direction while the second anti-mismating groove 361 extends upwardly along the vertical direction. The first anti-mismating groove 351 and the second anti-mismating groove 361 are partly overlap along a horizontal direction perpendicular to the vertical direction. When the receptacle connector 100 and the plug connector 200 are mating with each other, the anti-mismating blocks 122 are received in corresponding first anti-mismating groove 351 and second anti-mismating groove 361. Referring to FIGS. 5, 7, 9 and 13, under condition when the receptacle connector 100 can be suitably received in the upper port, the receptacle connector 100 can also be suitably received in the lower port after rotating 180 degrees.

Figure 10:
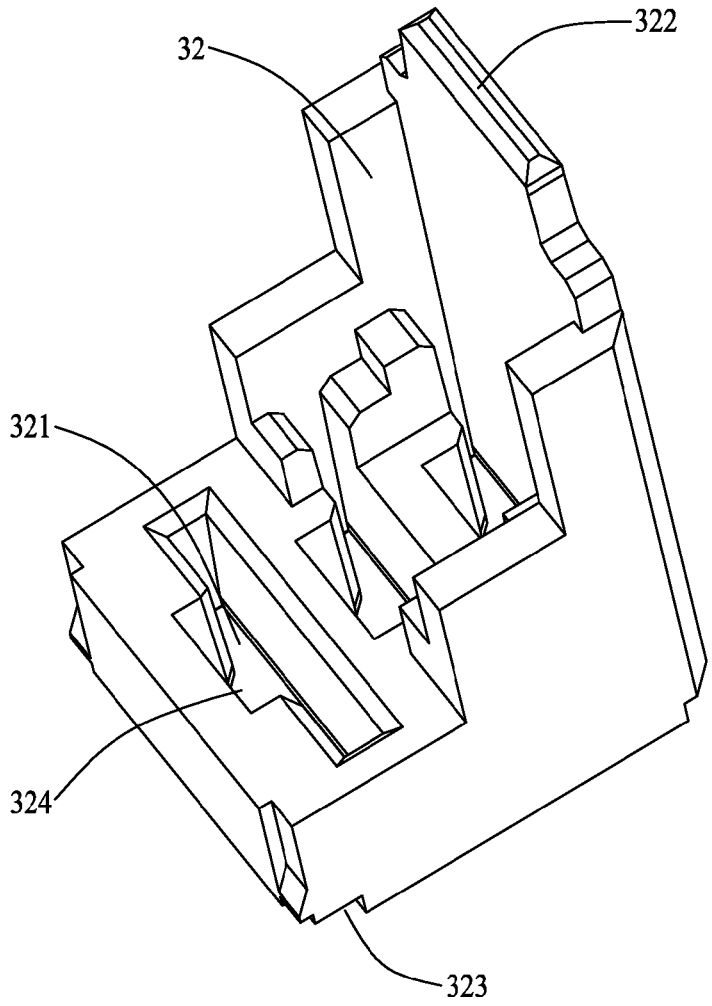
FIG. 10 is a perspective view of a spacer as shown in FIG. 8.
Figure 11:
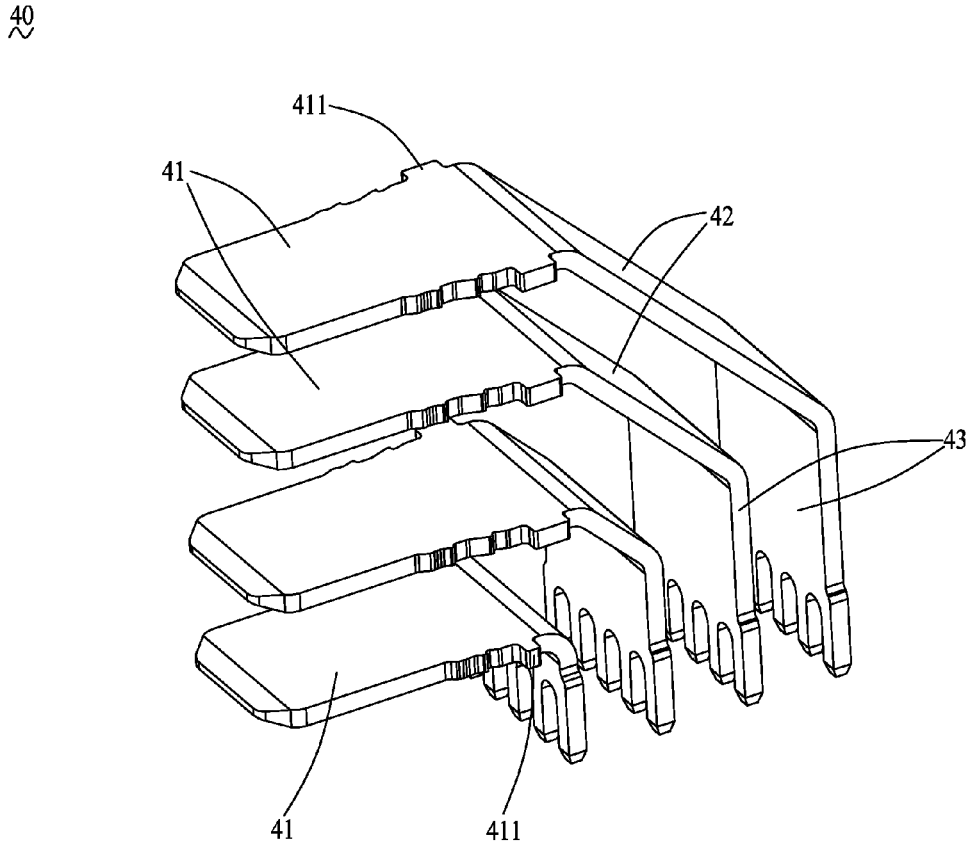
FIG. 11 is a perspective view of two groups of male contacts as shown in FIG. 8.

Referring to FIG. 10, the spacer 32 includes a plurality of slots 321 through which the male contacts 40 extend and a plurality of heat-dissipating slots 324 in communication with the slots 321. Heat generated by the male contacts 40 can be dissipated to the exterior from such heat-dissipating slots 324. The plug insulative housing 30 further includes a locking block 34 in communication with one of the cavities 33. When the spacer 32 is attached to the body portion 31, the locking block 34 engages with corresponding slot 321 for positioning.

The spacer 32 includes a protrusion 322 at its top side, and the body portion 31 includes a restricting block 311 extending downwardly from a top wall thereof for mating with the protrusion 322. Besides, the body portion 31 includes a plurality of locking protrusions 312 at its rear bottom side, and the spacer 32 includes a plurality of recesses 323 at its front bottom side for receiving the locking protrusions 312. As a result, the spacer 32 can be effectively fixed to the body portion 31.

Referring to FIGS. 9 to 12, the plurality of male contacts 40 are divided into groups each of which includes two male contacts 40. Each male contact includes a flat/rigid contacting portion 41 residing in corresponding cavity 33, a mounting portion 43 mounting to a circuit board and an inclined portion 42 connecting the contact portion 41 and the mounting portion 43. The contacting portion 41 includes a plurality of barbs 411 fixed in corresponding contact-receiving slot 332 for holding the male contacts 40. Either the angle between the inclined portion 42 and the contacting portion 41, or the angle between the inclined portion 42 and the mounting portion 43 is larger than 90 degrees.

Figure 12:
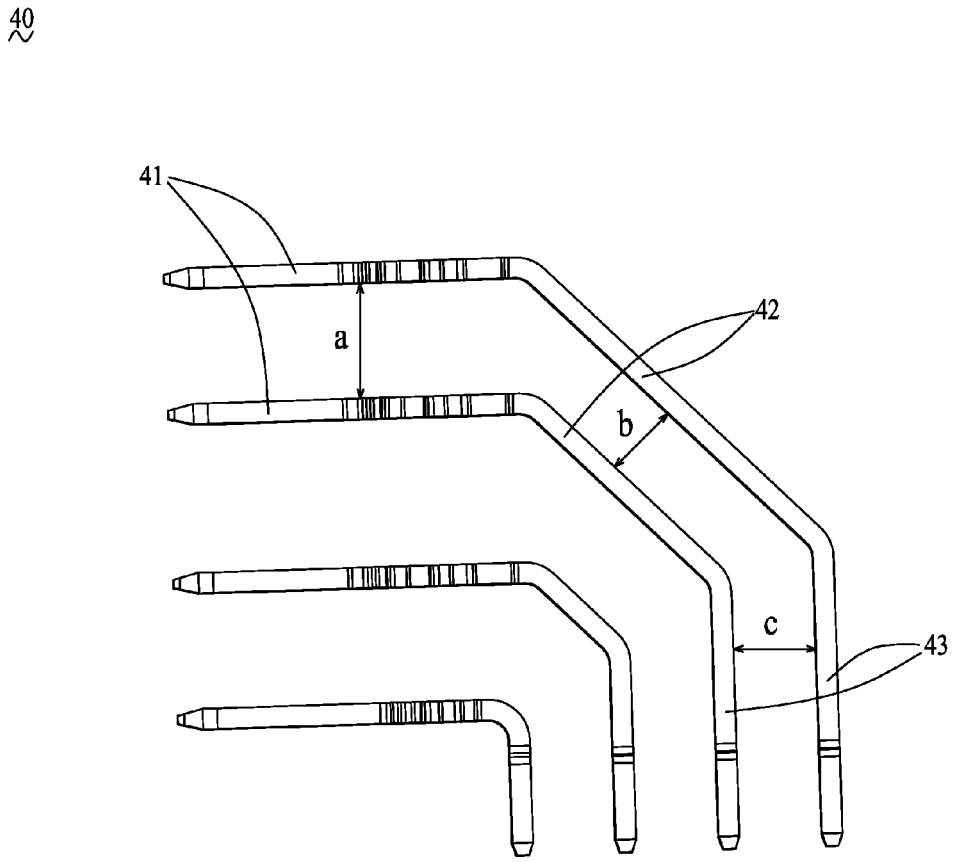
FIG. 12 is a side view of the two groups of male contacts as shown in FIG. 11.

The contacting portions 41, the inclined portions 42 and the mounting portions 43 of the male contacts 40 are parallel with each other, correspondingly. As shown in FIG. 12, in each group, a distance "a" between the flat contacting portions 41 is larger than a gap "b" between the inclined portions 42 and the gap "b" between the inclined portions 42 is no less than a gap "c" between the mounting portions 43. With such design of the male contacts 40, signal transmission quality can be improved, and material of the male contacts 40 can be saved.

Figure 13:
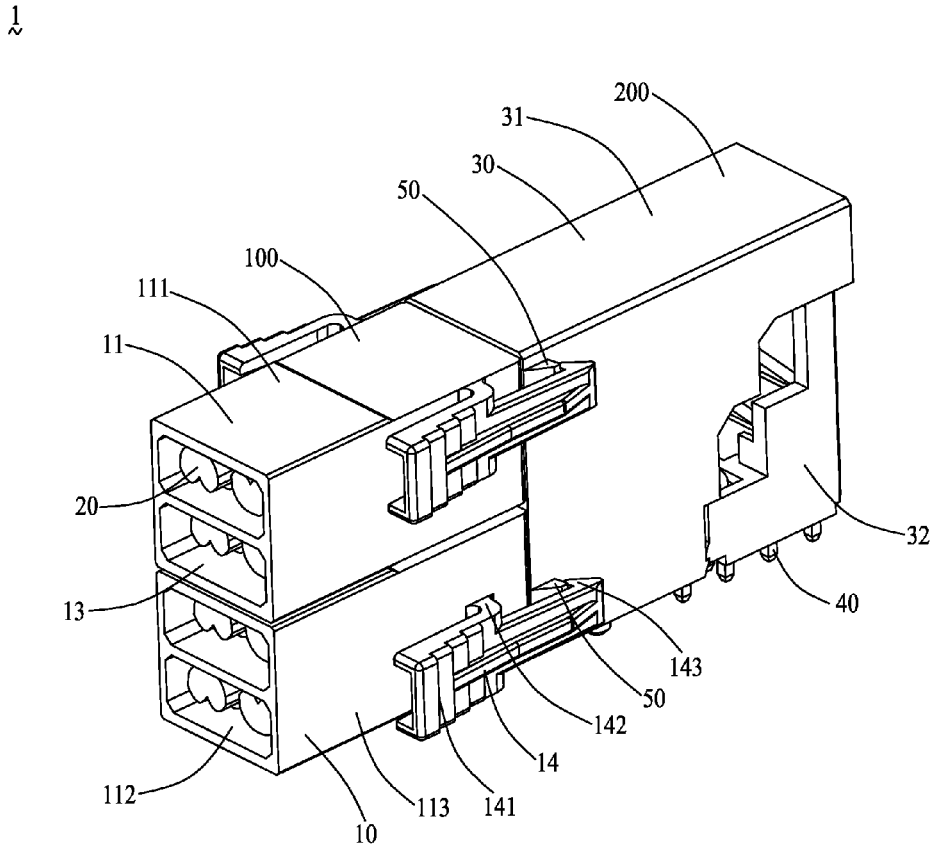
FIG. 13 is a perspective view of a connector assembly with a receptacle connector locking with a plug connector in accordance with a first illustrated embodiment of the present invention.

Referring to FIGS. 8 and 13, the plug connector 200 includes a plurality of locking members 50 for locking with the hooks 143 of the locking arms 14. According to a first embodiment of the present invention, the locking members 50 include two pairs of blocks 39 on opposite side walls of the plug insulative housing 30. The two pairs of blocks 39 are located adjacent to the front mating surface 313. Each block 39 includes a front inclined guiding surface 391 and a rear wall 392 which functions as a locking wall for mating with the hook 143.

Figure 14:
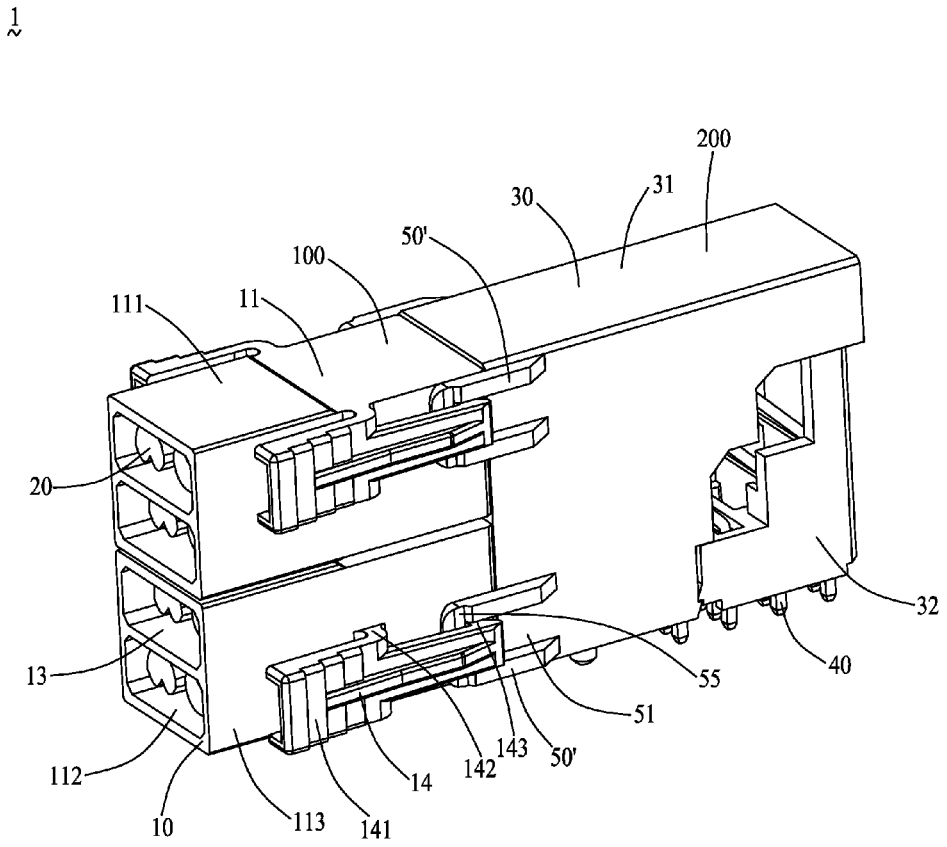
FIG. 14 is a perspective view of a connector assembly with a receptacle connector locking with a plug connector in accordance with a second illustrated embodiment of the present invention.

Referring to FIG. 14, according to a second embodiment of the present invention, the locking members 50' are U-shaped and formed on opposite side walls of plug insulative housing 30. Each pair of locking members 50' protrude forwardly beyond the front mating surface 313. Each locking member 50' includes a slot 51 for partly receiving the locking arms 14 and a front beam 55 which functions as a locking wall for mating with the hook 143.

Figure 15:
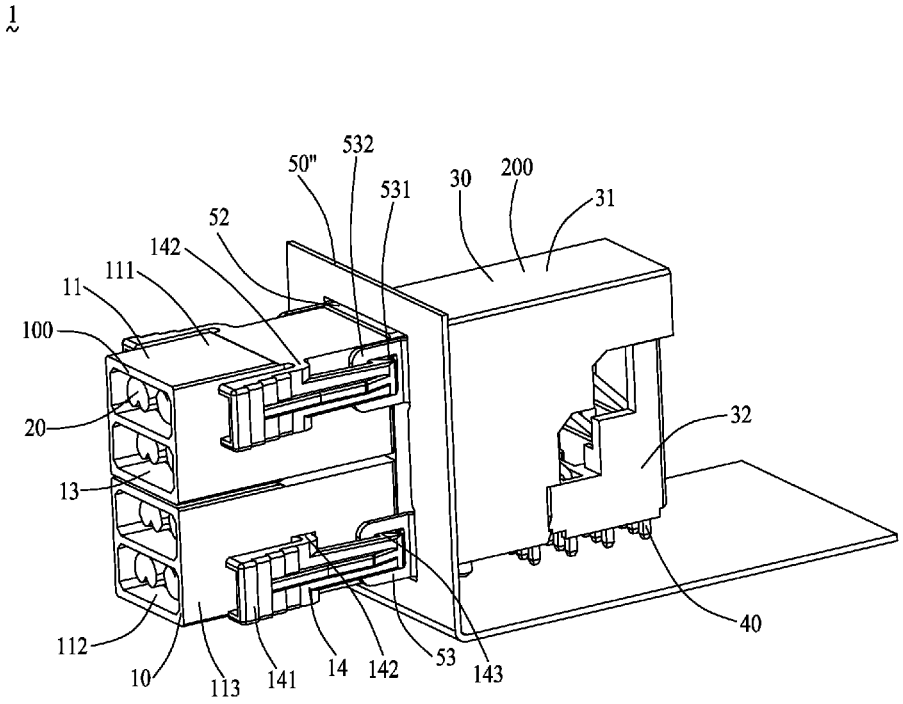
FIG. 15 is a perspective view of a connector assembly with a receptacle connector locking with a plug connector in accordance with a third illustrated embodiment of the present invention.

Referring to FIG. 15, according to a third embodiment of the present invention, the plug connector 200 includes an L-shaped frame as a locking member 50". The frame defines an opening 52 through which the plug insulative housing 30 extends, and two pairs of protrusions 53 perpendicularly bent from inner edges of the opening 52. Each protrusion 53 includes a slot 531 for partly receiving the locking arms 14 and a front beam 532 which functions as a locking wall for mating with the hook 143.

According to the above description, with the locking walls locking with the hooks 143 of the locking arms 14, the mating stability of the plug connector 200 and the receptacle connector 100 can be improved.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A connector assembly comprising:

a receptacle connector and a plug connector mating with the receptacle connector;

the receptacle connector comprising:

a receptacle insulative housing comprising a receiving portion, a plurality of mating portions extending from the receiving portion and a pair of locking arms integrally formed at opposite lateral sides of the receptacle insulative housing; and a plurality of female contact groups fixed in the receptacle insulative housing, each female contact group comprising a pair of resilient contacting portions;

the plug connector comprising:

a plug insulative housing comprising a mating surface, a plurality of cavities extending through the mating surface and a pair of locking walls located at opposite lateral sides of the plug insulative housing; and a plurality of male contacts fixed in the plug insulative housing, each male contact comprising a rigid contacting portion extending into corresponding cavity; wherein when the plug connector the receptacle connector are mating with each other, the mating portions of the receptacle connector are inserted in the cavities of the plug connector with the rigid contacting portion sandwiched by the pair of resilient contacting portions, and the locking arms are in locking with the locking walls for fixation;

and wherein each female contact group comprises first and second female contacts combined together, each of the first and second contacts comprising a retaining portion and the contacting portion extending forwardly from the retaining portion, each retaining portion comprising a first locking portion and a second locking portion on opposite lateral side thereof, respectively, each first locking portion comprising a slit, each second locking portion comprising a positioning portion and an engaging arm outside of the positioning portion; and wherein the retaining portion and the contacting portion of the first female contact are of the same configuration as the retaining portion and the contacting portion of the second female contact after rotating 180 degrees.

2. The connector assembly as claimed in claim 1, wherein the pair of locking arms are integrally formed at opposite side walls of the receiving portion.

3. The connector assembly as claimed in claim 2, wherein the receiving portion comprises a top wall and a bottom wall opposite to the top wall, the pair of locking arms being located adjacent to either the top wall or the bottom wall along a vertical direction.

4. The connector assembly as claimed in claim 1, wherein each locking arm comprises a pivot portion integrally connected to the receiving portion, a pressing portion for deforming the locking arm and a distal hook for locking with the locking wall.

5. The connector assembly as claimed in claim 1, wherein the plug insulative housing comprises a pair of blocks on opposite side walls thereof, the pair of blocks being located adjacent to the mating surface, each block comprising a front inclined guiding surface and a rear wall which functions as the locking wall.

6. The connector assembly as claimed in claim 1, wherein the plug insulative housing comprises a pair of locking members on opposite side walls thereof, the pair of locking members protruding forwardly beyond the mating surface, each locking member comprising a slot for partly receiving the locking arms and a front beam which functions as the locking wall.

7. The connector assembly as claimed in claim 6, wherein each locking member is U-shaped and extends in parallel relationship with respect to the side walls.

8. The connector assembly as claimed in claim 1, wherein the plug connector comprises a frame which defines an opening through which the plug insulative housing extends, the frame further comprising a pair of protrusions perpendicularly bent from inner edges of the opening, each protrusion comprising a slot for partly receiving the locking arms and a front beam which functions as the locking wall.

9. The connector assembly as claimed in claim 1, wherein the plurality of mating portions are stacked along a vertical direction, at least one of the mating portions comprises a trapezoid anti-mismating block at a corner thereof.

10. The connector assembly as claimed in claim 9, wherein the plurality of mating portions comprise an upper mating portion and a lower mating portion, the trapezoid anti-mismating block being formed on the lower mating portion and protruding along a direction opposite to the upper mating portion.

11. The connector assembly as claimed in claim 1, wherein when the first female contact is combined in position with the second female contact, the positioning portion of the first female contact extends through the slit of the second female contact and the positioning portion of the second female contact extends through the slit of the first female contact, simultaneously.

12. The connector assembly as claimed in claim 1, wherein each of the first and second female contacts comprises a clip portion extending rearwardly from the retaining portion for mounting a cable, the clip portion of the first female contact is of the same configurations as the clip portion of the second female contact after rotating 180 degrees.

13. The connector assembly as claimed in claim 12, wherein in the same female contact group, the contacting portions of the first and second female contacts are located one above the other along a vertical direction, while the clip portions of the first and second female contacts are located side by side along a horizontal direction perpendicular to the vertical direction.

14. A connector assembly comprising:

a receptacle connector and a plug connector mating with the receptacle connector;

the receptacle connector comprising:

a receptacle insulative housing comprising a receiving portion, a plurality of mating portions extending from the receiving portion and a pair of locking arms formed at opposite lateral sides of the receptacle insulative housing; and a plurality of female contact groups received in the receptacle insulative housing;

the plug connector comprising:

a plug insulative housing comprising a mating surface, a plurality of ports extending through the mating surface and a pair of locking walls located at opposite lateral sides of the plug insulative housing for locking with the locking arms, the plurality of ports comprising an upper port and a lower port; and a plurality of male contacts fixed in the plug insulative housing and extending into the upper port and the lower port; wherein under condition when the receptacle connector can be suitably received in the upper port, the receptacle connector can also be suitably received in the lower port after rotating 180 degrees;

and wherein each female contact group comprises first and second female contacts combined together, each of the first and second contacts comprising a retaining portion and the contacting portion extending forwardly from the retaining portion, each retaining portion comprising a first locking portion and a second locking portion on opposite lateral side thereof, respectively, each first locking portion comprising a slit, each second locking portion comprising a positioning portion and an engaging arm outside of the positioning portion; and wherein the retaining portion and the contacting portion of the first female contact are of the same configuration as the retaining portion and the contacting portion of the second female contact after rotating 180 degrees.

15. The connector assembly as claimed in claim 14, wherein the plug insulative housing comprises a first cavity of the upper port and a second cavity of the lower port, the second cavity being located under the first cavity, the plug insulative housing defining a first anti-mismating groove at a corner of the first cavity and a second anti-mismating groove at a corner of the second cavity, the first anti-mismating groove and the second anti-mismating groove being in communication with the first cavity and the second cavity, respectively, while the first anti-mismating groove and the second anti-mismating groove are offset along a vertical direction and extend along opposite directions.

16. The connector assembly as claimed in claim 15, wherein the first anti-mismating groove and the second anti-mismating groove are of trapezoid configurations.

17. The connector assembly as claimed in claim 15, wherein the first anti-mismating groove extends downwardly along the vertical direction while the second anti-mismating groove extends upwardly along the vertical direction.

18. The connector assembly as claimed in claim 17, wherein the first anti-mismating groove and the second anti-mismating groove are partly overlap along a horizontal direction perpendicular to the vertical direction.

19. The connector assembly as claimed in claim 14, wherein each of the opposite lateral sides of the receptacle insulative housing defines a sideward slot for dissipating heat.

* * * * *